US005622520A

United States Patent [19]

Dutka et al.

[11] Patent Number: 5,622,520

[45] Date of Patent: Apr. 22, 1997

[54] HIGH-DENSITY BOARD CONNECTOR ATTACHMENT

[75] Inventors: Peter L. Dutka, Wappingers Falls; Jeffrey J. Hare, Staatsburg; Norton J. Tomassetti, Kingston; William J. Tkazyik; Wade H. White, both of Hyde Park, all of N.Y.

[73] Assignee: International Business Machines Corporation, Armonk, N.Y.

[21] Appl. No.: 657,921

[22] Filed: May 31, 1996

Related U.S. Application Data

[63] Continuation-in-part of Ser. No. 624,670, Apr. 2, 1996, abandoned.

[51] Int. Cl.[6] ..... H01R 13/73

[52] U.S. Cl. ..... 439/573

[58] Field of Search ..... 439/571–573, 439/540.1

[56] References Cited

U.S. PATENT DOCUMENTS

| | | | |
|---|---|---|---|
| 3,825,800 | 7/1974 | Warman et al. | 439/540.1 |
| 4,134,632 | 1/1979 | Lindberg et al. | 439/572 |
| 4,420,767 | 12/1983 | Hodge et al. | 357/81 |
| 4,842,538 | 6/1989 | Noschese | 439/260 |
| 4,945,190 | 7/1990 | Fujioka | 174/68.5 |
| 5,044,966 | 9/1991 | Friesen | 439/78 |
| 5,108,296 | 4/1992 | Takano et al. | 439/92 |

*Primary Examiner*—Gary F. Paumen
*Attorney, Agent, or Firm*—Lawrence D. Cutter

[57] ABSTRACT

A printed circuit board includes a rectangular array of substantially equally spaced rows and columns of surface mount connectors which are fixedly held to the board by means of cross-shaped connector holders which are disposed at the intersections of the rows and columns. In this fashion, there is achieved a substantial reduction in the number of holes which must be provided in the printed circuit board for connector attachment. This greatly facilitates wiring placement on printed circuit boards, particularly multi-layer boards.

11 Claims, 2 Drawing Sheets

HIGH-DENSITY BOARD CONNECTOR ATTACHMENT

This application is a continuation-in-part of application Ser. No. 08/624,670, filed on Apr. 2, 1996, now abandoned.

BACKGROUND OF THE INVENTION

The present invention is generally directed to mounting input/output connectors on printed circuit boards. More particularly, the present invention is directed to a system for mounting connectors on PC boards in a dense fashion without the concomitant necessity of a large number of holes in the printed circuit board.

In certain printed circuit board designs in which electronic circuit chips are surface mounted to the boards, connections are made to the chips via a board edge connector. However, the present invention is not directed to such systems directly although it should be noted that the present invention is not inconsistent with the utilization of a board edge connector.

However, the present invention is particularly directed at those circumstances and situations in which a large number of connections are to be made to a printed circuit board, typically more connections than would be feasible with a board edge connector alone. In one particular embodiment of the present invention, the design employs a rectangular array of surface-mounted electronic circuit chips. In such a design, it is desirable to be able to access a large number of chip pins from the periphery of the chip, that is, at the chip site itself. Accordingly, in this design, there is provided a rectangular array of electronic circuit chips. The chips are surrounded by cable connectors which are also surface mounted to the printed circuit board.

In one design example, the rectangular array of chips is disposed as seven columns and nine rows of chip components. However, with a connector at virtually every one of the edges of the chips for interconnection purposes, this requires that 252 holes be drilled in the printed circuit board to facilitate attachment of the connectors.

However, it is to be particularly noted that the provision of or a requirement for a large number of holes in the printed circuit board has decided negatively consequences. In particular, the larger the number of holes present in a printed circuit board, the weaker the board will be and, concomitantly, will be more subject to bending and flexing both of which are qualities that are not desired in printed circuit boards containing electrically conductive patterns which could be broken. Furthermore, the presences of a large number of holes in a printed circuit board means that the design of the board will include more wire routing problems since a portion of the board is no longer available as a foundation for the desired electronic circuit paths. Additionally, a large number of holes in the printed circuit board for connecting the individual surface mount connectors is undesirable in that it takes longer to manufacture such a board and, additionally, it takes a longer time to assemble the components that are to be attached to the board.

Accordingly, it is seen that conventional approaches to attachment of surface mount connectors to printed circuit boards leaves a lot to be desired in terms of their requirements for large number of holes which must be provided in the printed circuit board. Such holes are seen to complicate wiring layout and design which are critical processes in the manufacture of printed circuit boards.

It is important to note that electronic circuit chips are contained almost entirely in square or rectangular packages.

This naturally leads to circuit board placement in rectangular arrays in which a significant portion of the available wiring space on the board is to be found in the regions between the chips. In the present context, further constraints are introduced by the inclusion of large numbers of board level connectors. These connectors typically surround each chip and introduce many wiring barriers which are effectively walls which significantly inhibit layout and wiring design. The fact that the linear density of the connector is high (e.g. 25 mil lead spacing) in the regions of these board level connectors is a factor which contributes significantly to operation of the board connectors as barriers or walls to effective wiring. Thus, the presence of the board connectors very significantly exacerbates the wiring situation so that, especially in a rectangular array of chips and connectors, the board area in the region where four chip corners meet becomes extremely critical for wiring. Excess numbers of board holes in these corner areas impede, and in many cases, prevent the possibility of desired or needed board-level wiring. Thus, in certain circumstances, circuit boards with large numbers of on-board connectors can quickly become impossible to wire.

SUMMARY OF THE INVENTION

In accordance with a preferred embodiment of the present invention, surface mount connectors are positioned vertically and horizontally on a printed circuit board so as to create a number of intersections. At each one of these intersections, there is provided a connector holder which is attached to a retainer bar on the other side of the printed circuit board. The connector holder is shaped to overlap four connectors at once and to positively retain each connector in position. This is accomplished with only a single hole through the connector holder instead of four holes employed in conventional connector attachment design. Accordingly, the present invention is seen to provide a four-to-one advantage over conventional designs.

Accordingly, it is seen that in one embodiment of the present invention a printed circuit board assembly comprises a printed circuit board with at least one layer of wiring for interconnection of electronic components which are to be placed on the circuit board. There is also provided a rectangular array of substantially equally-spaced rows and equally-spaced columns of surface mount connectors which are disposed on the printed circuit board in an electrical connection with the wiring on the board. Connector holders are disposed at the intersections of the rows and columns for retaining ends of the connectors which meet at the intersections in fixed positions with respect to the board. A fastening means such as a machine screw is provided for affixedly mounting the connector to the board. In the preferred embodiments of the present invention, the fastening means extends through the connector holder and screws into a retaining bar which is provided with insulative standoffs for providing extra stiffness to the board.

Accordingly, it is an object of the present invention to reduce the number of holes that must be provided in a printed circuit board for the attachment of surface mount connectors.

It is an additional object of the present invention to provide printed circuit boards having increased resistance to bending and flexing.

It is yet another object of the present invention to provide a system for surface mount connector attachment which is less time consuming.

It is a still further object of the present invention to increase the ease with which multi-layer printed circuit boards may be wired.

It is yet another object of the present invention to provide the ability to wire a board which otherwise would have been impossible to manufacture due to its wiring density demands.

It is a further object of the present invention to decrease time required for printed circuit board assembly in those circumstances which require particularly large numbers of surface mount connectors to be attached to the printed circuit board.

It is a still further object of the present invention to reduce the cost of printed circuit board manufacture and assembly for those circumstances requiring circuit boards with surface mount connectors.

Lastly, but not limited hereto, it is an object of the present invention to provide a dense placement of surface mount connectors adjacent to electronic circuit chips on printed circuit boards to achieve greater flexibility, higher density design and higher density of chip connections.

DESCRIPTION OF THE DRAWINGS

The subject matter which is regarded as the invention is particularly pointed out and distinctly claimed in the concluding portion of the specification. The invention, however, both as to organization and method of practice, together with the further objects and advantages thereof, may best be understood by reference to the following description taken in connection with the accompanying drawings in which:

DETAILED DESCRIPTION OF THE INVENTION

Figure 1:
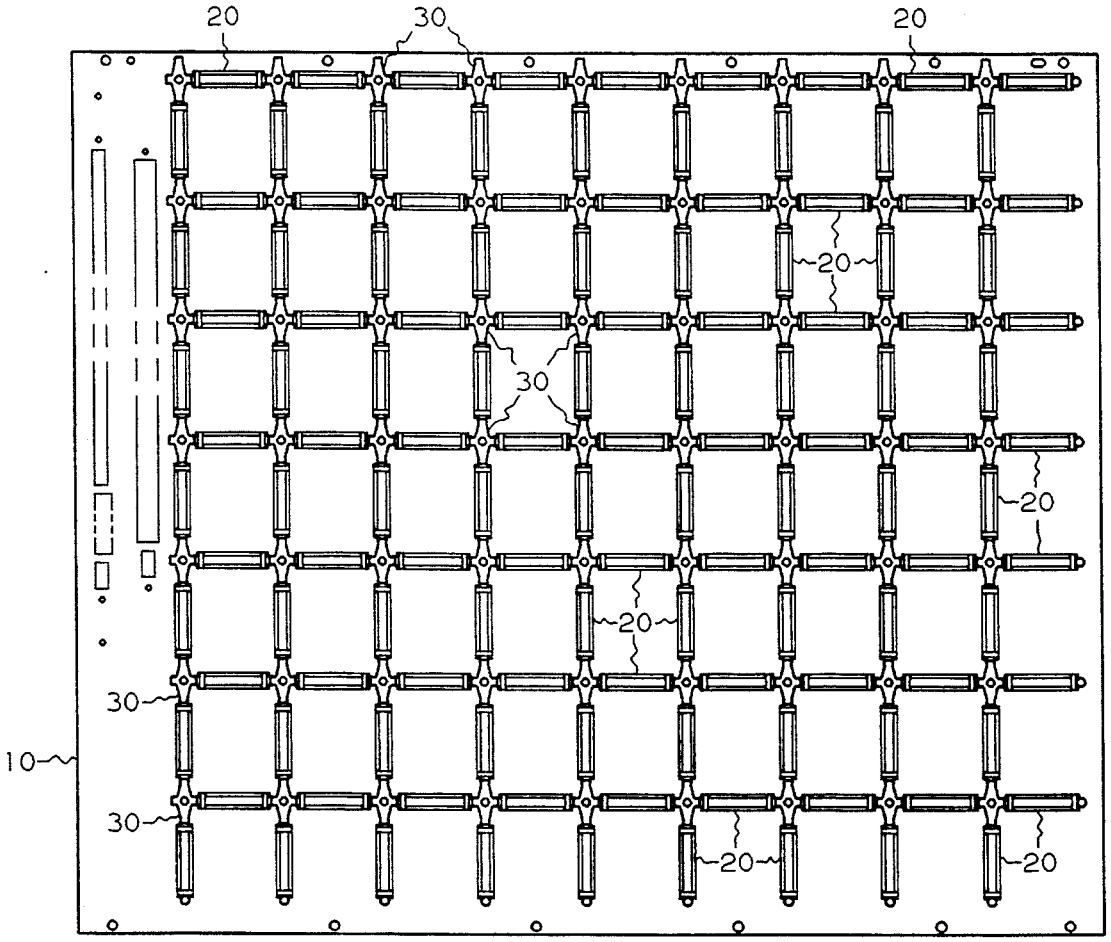
FIG. 1 is a top plan view of a printed circuit board in accordance with the present invention and particularly illustrates a rectangular array of surface mount connectors and connector holders disposed at the intersections of the rows and columns of these connectors.

In accordance with a preferred embodiment of the present invention, a plan view illustrating the placement of surface mount connectors on a printed circuit board is shown in FIG. 1. In particular, it is to be noted that surface connectors 20 are disposed in a rectangular array of rows and columns on printed circuit board 10. More particularly, it is also to be noted that at each row and column intersection, there is provided connector holder 30 which holds up to four connectors 20 in position. Although not specifically shown in FIG. 1 (for purposes of clarity) it is to be particularly noted that, in each of the rectangular cells shown in FIG. 1, there is typically disposed an electronic circuit chip which is connected to the wiring present on and within circuit board 10. Likewise, for purposes of clarity, the printed circuit wiring itself is not shown.

Figure 2:
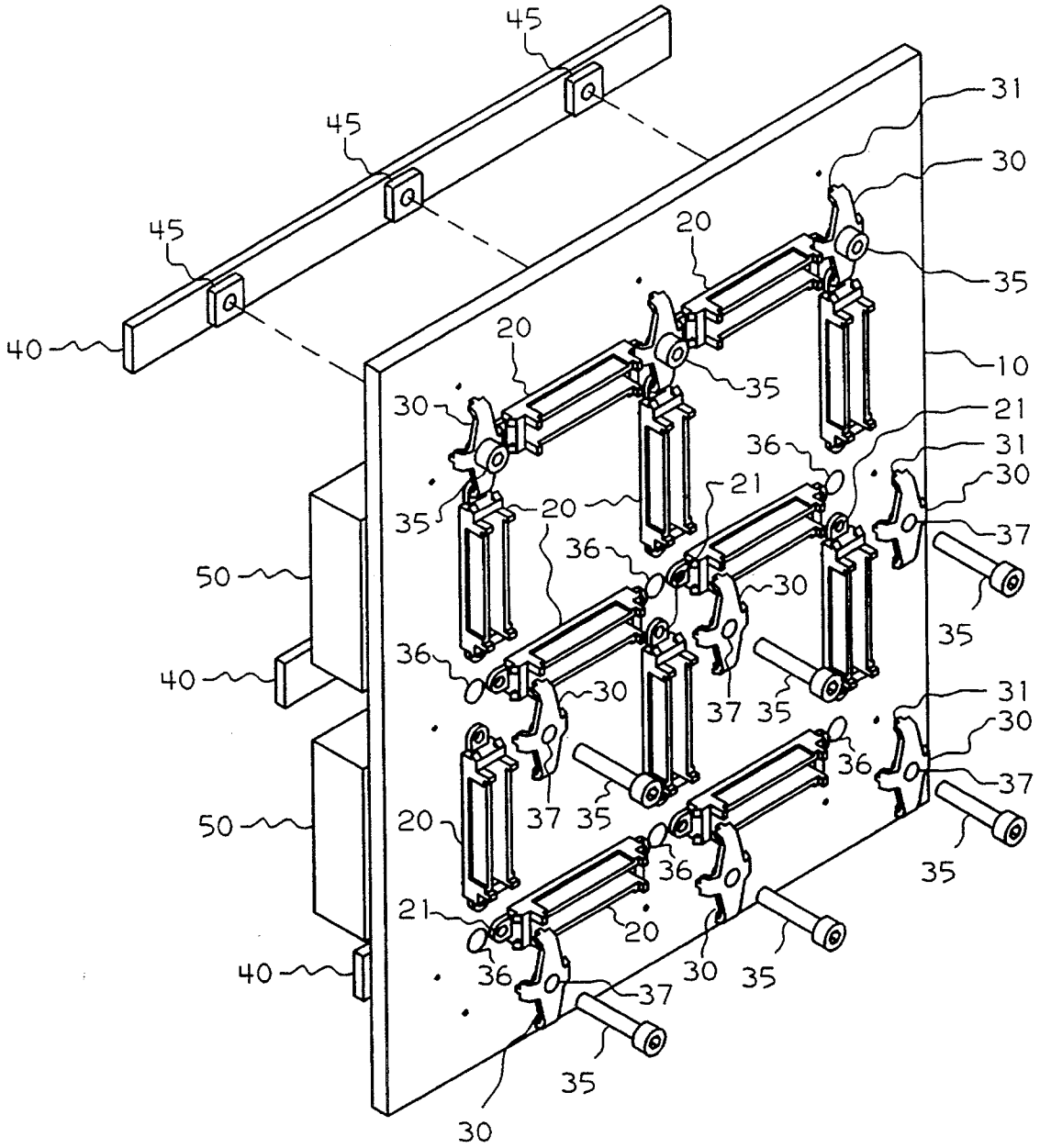
FIG. 2 is a an isometric view of a portion of the circuit board shown in FIG. 1 showing the connections in greater detail and, in particular, illustrating the use and placement of the retaining bar.

A more detailed view of the present invention is seen in FIG. 2. FIG. 2 represents a view of a relatively small portion of circuit board 10 shown in FIG. 1. The enlarged view shown in FIG. 2 provides additional detail and clarity. In particular, it is seen that fastener 35 is disposed through opening 37 in connector holder 30. It is further seen that connector holder 30 is, in the embodiment shown, a cross-shaped piece having four arms extending from central opening 37. It is further seen that each arm is employed to hold down one end of connector 20 (and/or to compensate for the lack of a connector, especially at the corners or along the edges). Thus, only one opening 36 in printed circuit board 10 is required rather than having a hole for each connector end.

It should also be noted in FIG. 2 that certain connector holders 30 are disposed at the edges or corners of the array. For edge-mounted connector holders, their arms are only required to hold down three (as opposed to four) connectors. Similarly, corner-mounted connector holders are only required to hold down two (as opposed to three or four) connectors. In such cases, it is possible, though not necessary, to provide connector holders 30 with differently sized arms. Preferably though, connector holders 30 comprise a resilient material. Even more preferably, connector holders 30 include arm projections 31 which extend through openings 21 in connectors 20. Arm projections 31 thus provide shoulders which rest upon connectors 20 to hold them firmly to circuit board 10. In addition, connector holders 30 preferrably comprise a flexible material exhibiting a restorative force when urged against connectors 30 by screws 35. Such a preferable material is spring steel formed by stamping which is viewed as the most economical method of production. However, connector holders 30 may also comprise a molded plastic.

In preferred embodiments of the present invention, fastening means 35 comprises a machine screw which is disposed through opening 37 in connector holder 30 and through opening 36 in printed circuit board 10. Fastening means 35 preferably comprises a machine screw which is screwed into corresponding threads present in retaining bar 40. Having retaining bar 40 provided with threaded openings reduces the number of parts which must be provided and handled. Additionally, it is noted that insulative standoffs or washers 45 may be provided, as shown. Retaining bars 40 also provide a very desirable board strengthening mechanism.

In preferred embodiments of the present invention, connector holders 30 preferably comprise a rigid stamped, spring steel part, since it is a stiff and durable metal. Likewise, retaining bar 40 also preferably comprises a stiff metal material. It is also noted that circuit board 10 may include circuit components 50 which are disposed on its opposite side.

As indicated above, fastening means 35 preferably includes a machine screw which is threaded directly into retaining bar 40. However, it is noted that a separate nut and/or washer may be employed with fastener 35 being disposed through an unthreaded opening in retaining bar 40. Likewise, the fastening mechanism can also include rivets, pins or any other convenient fastening means.

It is noted in FIGS. 1 and 2 herein that the array of connectors shown is not only rectangular, but the connectors define equally sized square cells on the board. This equal placement and sizing is not a strict requirement of the present invention although it is convenient when all of the chips which are to be placed on a printed circuit board are the same size and shape. In the event that technology provides chips which are not square, it is noted that the inventive aspects of the present invention are, nonetheless, still applicable. For example, if chips are disposed in hexagonal packages, the present invention can employ surface mount connectors all of which are of the same size and which are disposed in a honeycomb fashion with each cell being defined by six connectors arranged in a hexagonal pattern. Clearly in such cases, connector holders 30 include six arms as opposed to four arms shown in FIG. 2. Other patterns of connectors are also possible including an equilateral triangular configuration. However, it is noted that with current technology and practices, the rectangular array is the preferred embodiment.

From the above, it should be appreciated that all of the objectives cited have been met by the embodiments of applicants' invention shown in FIGS. 1 and 2. In particular, it should be noted that, for the embodiment shown, it is necessary only to provide 79 openings or through-holes in printed circuit board 10 rather than the 252 holes which would otherwise be required.

While the invention has been described in detail herein in accordance with certain preferred embodiments thereof, many modifications and changes therein may be effected by those skilled in the art. Accordingly, it is intended by the appended claims to cover all such modifications and changes as fall within the true spirit and scope of the invention.

The invention claimed is:

1. A printed circuit board assembly comprising:

a printed circuit board having at least one layer of wiring for interconnection of electronic components disposed thereon;

a rectangular array of rows and columns of surface mount connectors disposed on said board in electrical connection to said wiring, at least three of said connectors meeting at some intersections of said rows and columns;

connector holders disposed at at least some intersections of said rows and columns, each connector holder for retaining all the ends of said connectors, which meet at a corresponding said intersection, in fixed positions with respect to said board; and fastening means for affixedly mounting said connector holders to said board.

2. The assembly of claim 1 in which said printed circuit board is a multi-layer board.

3. The assembly of claim 1 in which said fastening means is a nut and bolt.

4. The assembly of claim 1 in which said connector holders comprise cross-shaped members having a central opening therein for passage therethrough there through of said fastening means.

5. The assembly of claim 1 further including at least one retaining bar disposed along a row or column of said rectangular array, on the opposite side of said printed circuit board then said connectors, said retaining bar also being affixed to said printed circuit board by said fastening means.

6. The assembly of claim 5 in which, at least some of said intersections, standoff means are disposed between said retaining bar and said printed circuit board.

7. The assembly of claim 1 in which said connector holders comprise metal stampings.

8. The assembly of claim 1 further including electronic circuit components attached to said printed circuit board in at least some of the areas defined by said rows and columns of said connectors.

9. The assembly of claim 5 in which said fastener means comprise machine screws which are threaded directly into threaded openings in said retaining bar.

10. The assembly of claim 6 in which said standoff means are insulative.

11. The assembly of claim 1 in which said connector holders include arms having end projections which extend at least partially through openings in said surface mount connectors.

* * * * *